US008038423B2

(12) United States Patent
Nakayoshi

(10) Patent No.: US 8,038,423 B2
(45) Date of Patent: Oct. 18, 2011

(54) ELECTRIC PUMP WITH RELIEF VALVE

(75) Inventor: Hideki Nakayoshi, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 371 days.

(21) Appl. No.: 12/349,651

(22) Filed: Jan. 7, 2009

(65) Prior Publication Data

US 2009/0175751 A1 Jul. 9, 2009

(30) Foreign Application Priority Data

Jan. 8, 2008 (JP) ..... 2008-001482

(51) Int. Cl.
*F03C 4/00* (2006.01)
*F04C 18/00* (2006.01)
*F04C 2/00* (2006.01)

(52) U.S. Cl. ..... 418/171; 418/132; 418/180; 418/270; 417/310; 417/356; 417/410.4; 310/261.1

(58) Field of Classification Search ..... 418/131, 418/132, 166, 171, 180, 270; 417/310, 356, 417/410.1, 410.4; 310/261.1, 40 R
See application file for complete search history.

(56) References Cited

U.S. PATENT DOCUMENTS

| | | | | | |
|---|---|---|---|---|---|
| 2,380,783 | A | * | 7/1945 | Painter | 418/166 |
| 2,871,793 | A | * | 2/1959 | Michie et al. | 418/171 |
| 4,519,755 | A | * | 5/1985 | Hanson | 418/171 |
| 4,897,025 | A | * | 1/1990 | Negishi | 418/171 |
| 4,969,806 | A | | 11/1990 | Nusser | |
| 4,971,528 | A | * | 11/1990 | Hodgkins et al. | 417/310 |
| 5,713,726 | A | * | 2/1998 | Nakayoshi | 417/310 |
| 2005/0186089 | A1 | | 8/2005 | Nakayoshi et al. | |
| 2006/0222527 | A1 | * | 10/2006 | Kurita et al. | 417/410.1 |
| 2008/0159885 | A1 | | 7/2008 | Kameya et al. | |

FOREIGN PATENT DOCUMENTS

| | | | | |
|---|---|---|---|---|
| DE | 3900263 | A1 | | 7/1990 |
| EP | 1 526 282 | A1 | | 4/2005 |
| EP | 1 566 545 | A2 | | 8/2005 |
| FR | 1 399 932 | A | | 5/1965 |
| JP | 60081489 | A | * | 5/1985 |
| JP | 60-149892 | U | | 10/1985 |
| JP | 06-200722 | A | | 7/1994 |
| JP | 2003129966 | A | * | 5/2003 |
| JP | 2006-336469 | A | | 12/2006 |

OTHER PUBLICATIONS

Search Report issued Jul. 13, 2011 by the European Patent Office in European Patent Application No. 08022148, 7 pgs.

* cited by examiner

*Primary Examiner* — Theresa Trieu
(74) *Attorney, Agent, or Firm* — Buchanan Ingersoll & Rooney PC

(57) ABSTRACT

According to an aspect of the present invention, an electric pump includes: a housing; an outer rotor; an inner rotor; a base member facing one side surface of the outer rotor and one side surface of the inner rotor; a side plate member, having a facing surface facing the other side surface of the outer rotor and the other side surface of the inner rotor and a non-facing surface opposed to the facing surface; a shaft; a suction port; a discharge port; a negative pressure applied region; a positive pressure applied region; and a relief valve, discharging the fluid from the positive pressure applied region to a non-facing surface side of the side plate member when a pressure applied at the positive pressure applied region exceeds a predetermined value.

13 Claims, 5 Drawing Sheets

ELECTRIC PUMP WITH RELIEF VALVE

CROSS REFERENCE TO RELATED APPLICATIONS

This application is based on and claims priority under 35 U.S.C. §119 to Japanese Patent Application 2008-001482, filed on Jan. 8, 2008, the entire contents of which is incorporated herein by reference.

FIELD OF THE INVENTION

This invention relates to an electric pump including a pump portion having an outer rotor and an inner rotor.

BACKGROUND

A known electric pump is disclosed in JP2006-336469A (which is hereinbelow referred to as reference 1). According to the electric pump in reference 1, a trochoid-type pump portion is configured by providing an inner rotor in an outer rotor. A rotor is formed by providing a permanent magnet along an outer circumferential surface of the outer rotor. A casing is provided at a position surrounding the outer rotor. A stator, around which plural wires are respectively wound, is provided at a portion of the casing surrounding the outer rotor. Electric power is supplied to each of the wires of the stators by an inverter circuit, thereby the outer rotor is rotated, and the inner rotor is rotated accompanying the rotation of the outer rotor, so as to function as a pump.

For example, in an electric pump which supplies lubricating oil to an engine of a vehicle, a relief valve is provided at an oil passage, through which operation fluid is discharged from the electric pump, so as to prevent oil from being excessively pressurized.

In a case where a relief valve is provided at an oil passage system, assembly of an oil passage system may require time and labor. In order to simplify the tasks required for assembling the oil passage system, a relief valve may be provided between a suction port and a discharge port of the electric pump, as disclosed in JP60-149892.

In such a case where the relief valve is provided between the suction port and the discharge port, a thickness of a whole electric pump in a direction of a rotational axis is enlarged, thus to upsize the electric pump per se.

A need thus exits for an electric pump that is not susceptible to the drawback mentioned above.

SUMMARY OF THE INVENTION

According to an aspect of the present invention, an electric pump includes: a housing; an outer rotor, accommodated in the housing and rotated around a first axis by means of a magnetic field produced by the housing; an inner rotor, rotated around a second axis displaced to the first axis in a manner where an outer circumference thereof contacts an inner circumference of the outer rotor; a base member, facing one side surface of the outer rotor and one side surface of the inner rotor; a side plate member, having a facing surface facing the other side surface of the outer rotor and the other side surface of the inner rotor and a non-facing surface opposed to the facing surface; a shaft, rotatably supporting the inner rotor and extending from the base member through the side plate member in a direction of the second axis; a suction port, provided at the base member and sucking fluid; a discharge port, provided at the base member and discharging fluid to an exterior of the hosing; a negative pressure applied region, provided between the outer rotor and the inner rotor and communicating to the suction port; a positive pressure applied region, provided between the outer rotor and the inner rotor and communicating to the discharge port; and a relief valve, discharging the fluid from the positive pressure applied region to a non-facing surface side of the side plate member when a pressure applied at the positive pressure applied region exceeds a predetermined value.

BRIEF DESCRIPTION OF THE DRAWINGS

The foregoing and additional features and characteristics of the present invention will become more apparent from the following detailed description considered with the reference to the accompanying drawings, wherein.

DETAILED DESCRIPTION

Figure 1:
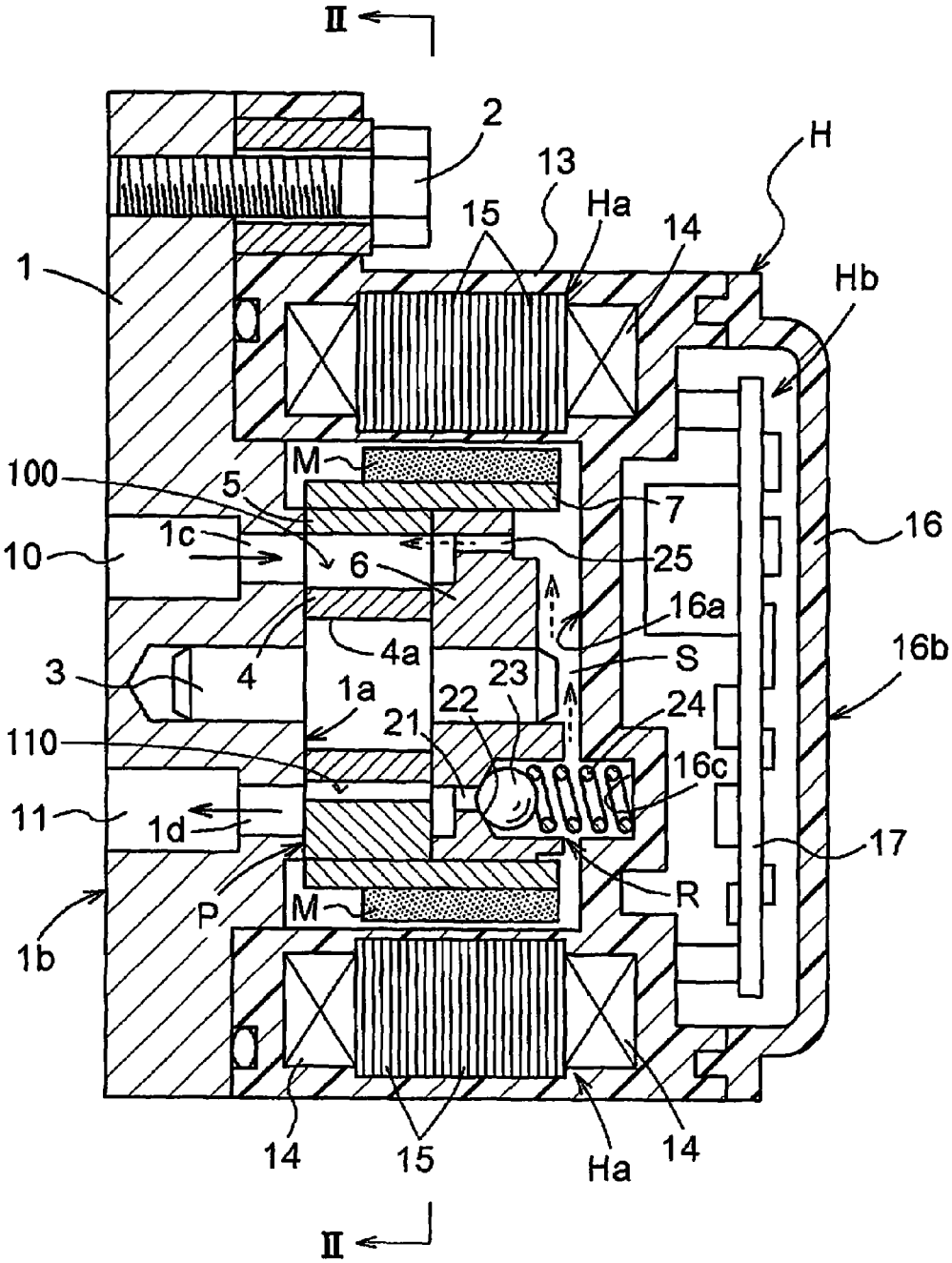
FIG. 1 is a cross-sectional view illustrating an arrangement of a base member and a housing.
Figure 2:
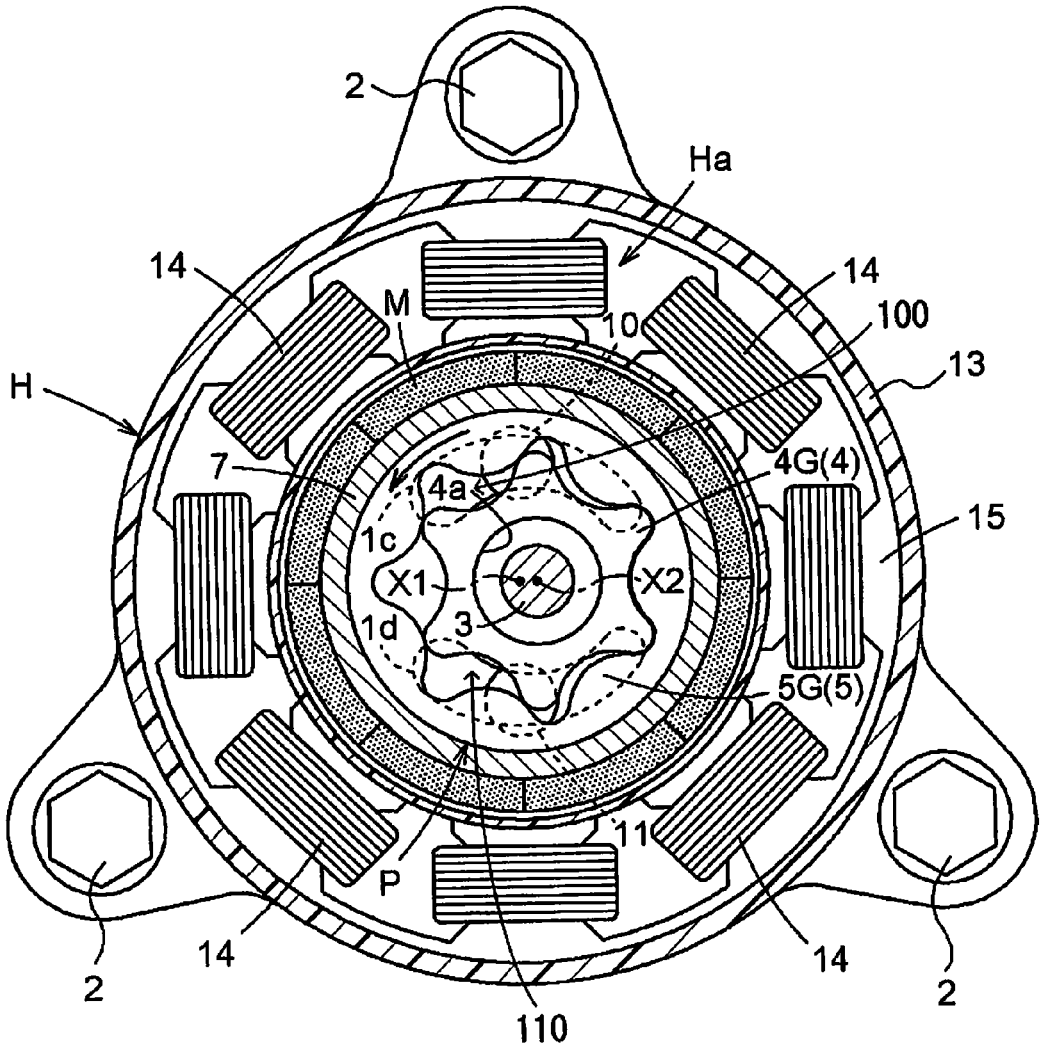
FIG. 2 is a cross-sectional view taken along line II-II in FIG. 1.
Figure 3:
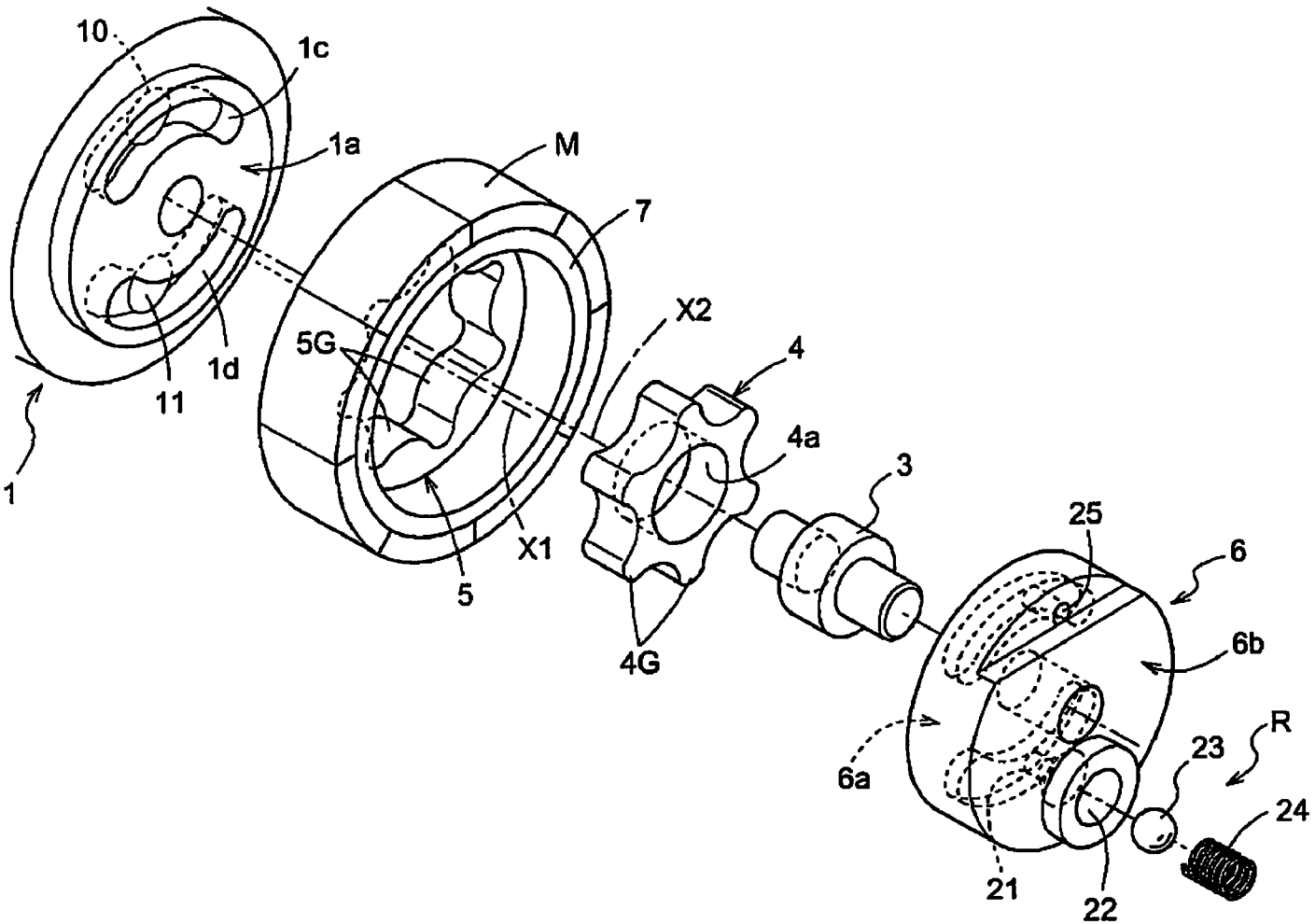
FIG. 3 is an exploded perspective view illustrating a pump portion and a relief valve.

An embodiment of an electric pump according to the present invention is described hereinbelow with reference to the attached drawings. As illustrated in FIGS. 1, 2, and 3, an electric pump is configured by connecting and fixing a housing H to a base member 1 by means of bolts 2. A trochoid-type pump portion P is supported by and fitted into the housing H. The electric pump is applied for supplying lubricating oil (fluid), for example, to an automobile engine.

The pump portion P includes the base member 1, a shaft 3, an inner rotor 4, an outer rotor 5 and a side plate member 6. The base member 1 is formed into a plate shape. One end of the shaft 3 is inserted into and fixed at the base member 1. The inner rotor 4 is rotatably supported by an intermediate portion of the shaft 3. First teeth 4G are provided at an outer circumference of the inner rotor 4. Second teeth 5G are provided at an inner circumference of the outer rotor 5. The first teeth 4G are engaged with the second teeth 5G. The other end of the shaft 3 is inserted into and fixed at the side plate member 6.

The outer rotor 5 is rotated around a main axis X1 (a first axis). The inner rotor 4 is rotated around a sub axis X2 (a second axis). The sub axis X2 is provided at a position displaced at a predetermined distance relative to the main axis X1 so as to be in parallel therewith. A hole portion 4*a* is provided at the inner rotor 4. The shaft 3 is inserted into the hole portion 4*a* so as to rotate relative to the hole portion 4*a*. The shaft 3 and the inner rotor 4 share the sub axis 2.

A plural of first teeth 4G, whose shapes of teeth surfaces curves along a trochoid curve line, is provided at the outer circumference of the inner rotor 4. The second teeth 5G, which include one additional tooth relative to the first teeth 4G, are provided at the inner circumference of the outer rotor 5. Tooth surfaces of the second teeth 5G of the outer rotor 5 are formed to contact the first teeth 4G of the inner rotor 4 when the inner rotor 4 is rotated around the sub axis X2 in accordance with a rotation of the second teeth 5G of the outer rotor 5 around the main axis X1.

Each of the base member 1, the shaft 3, the inner rotor 4, the outer rotor 5 and the side plate 6 may be made of metallic material. Further, the inner rotor 4 and the outer rotor 5 may be molded out of resin material. Furthermore, components other than the inner rotor 4 and the outer rotor 5 may be made of resin material.

A predetermined clearance is provided between one side surface of the inner rotor 4 and the base member 1 and between one side surface of the outer rotor 5 and the base member 1. Further, a predetermined clearance is provided between the other side surface of the inner rotor 4 and the side plate member 6 and between the other side surface of the outer rotor 5 and the side plate member 6. Therefore, the inner rotor 4 and the outer rotor 5 smoothly slide relative to the base member 1 and the side plate member 6.

An inner base surface 1*a* is provided at one surface of the base member 1 facing the inner rotor 4 and the outer rotor 5. An outer base surface 1*b* is provided at the opposite surface of the base member 1. Likewise, an inner plate surface 6*a* (a facing surface) is provided at one surface of the side plate member 6 facing the inner rotor 4 and the outer rotor 5. An outer plate surface 6*b* (a non-facing surface) is provided at the opposite surface of the side plate member 6.

When the inner and outer rotors 4 and 5 are rotated, negative pressure is applied on a region where a depth of an engagement between the first and second teeth 4G and 5G of the inner and outer rotor 4 and 5 is shallowed accompanying a rotation of the inner and outer rotors 4 and 5. Such region is configured to be a negative pressure applied region 100. A suction opening portion 1*c* is provided at a portion of the inner base surface 1*a* corresponding to the negative pressure applied region 100. Positive pressure is applied on a region where the depth of the engagement between the first and second teeth 4G and 5G of the inner and outer rotors 4 and 5 is deepened accompanying the rotation of the inner and outer rotors 4 and 5. Such region is configured to be a positive pressure applied region 110. A discharge opening portion 1*d* is provided at a portion of the inner base surface 1*a* corresponding to the positive pressure applied region 110.

A suction port 10 and a discharge port 11 are provided at the outer base surface 1*b*. The suction port 10 communicates to the suction opening portion 1*c*. The discharge port 11 communicates the discharge opening portion 1*d*. A relief valve R, which will be described hereinbelow, is provided at a side plate member 6.

A cylinder 7 is provided along an outer circumference of the outer rotor 5. A length of the cylinder 7 in a direction of the main axis X1 is longer than a thickness of the outer rotor 5 (i.e. a length thereof in a direction of the main axis X1). An outer circumferential surface of the side plate member 6 is formed so as to contact an inner circumferential surface of the cylinder 7. A cylindrically-shaped permanent magnet M is engaged with and fixed at an outer circumferential surface of the cylinder 7 at a position displaced so as to be spaced away from the base member 1. The north pole and the south pole are provided one after the other in the permanent magnet M.

The housing H is configured by connecting a cylindrically-shaped magnetic field producing portion Ha and an electric power control portion Hb. The magnetic producing portion Ha is arranged at a position surrounding the permanent magnet M that is provided at the outer rotor 5. The electric power control portion Hb is provided at the housing H at a position corresponding to the outer plate surface 6*b* of the side plate member 6. The electric power control portion Hb controls electric power supplied to the magnetic producing portion Ha. The magnetic filed produce portion Ha is configured so that a plural of cores 15 is provided inside the first resin case 13 of a sealed structure. The plurality of cores 15 are respectively wound with coils 14, made of conductors, and made of laminated magnetic steel plates. The electric power control portion Hb is configured so that a board 17 is provided inside the second resin case 16 of a sealed structure. The board 17 includes a driver circuit, formed from an electric power transistor, and a sensing processing portion that determines a rotational position of the outer rotor 5 based on counter electromotive force of the coils 14.

In the second resin case 16 surrounding the electric power control portion Hb of the housing H, one surface of the second resin case 16 facing the pump portion is formed into an inner wall surface 16*a* (an inner wall). The opposite surface of the second resin case 16 exposed is formed into an outer wall surface 16*b*.

The electric power control portion Hb of the housing H supplies driving electric power to the coils 14 of the magnetic producing portion Ha. Consequently magnetic force is applied on the permanent magnet M of the outer rotor 5 and thereby the outer rotor 5 is rotated.

A communication passage 21 is formed at the inner plate surface 6*a* of the side plate member 6 in parallel to the main axis X1 so as to communicate to the positive pressure applied region 110. A first recessed portion 22 is formed at the outer plate surface 6*b* of the side plate member 6 so as to be opened toward the housing (H). The first recessed portion 22 communicates to the communication passage 21. A diameter of the first recessed portion 22 is larger than a diameter of the communication passage 21. The relief valve R is configured by inserting a steel-made ball 23 (a valve body) into the first recessed portion 22 and by providing a helical compression spring 24 (a spring) at the first recessed portion 22. The helical compression spring 24 applies biasing force to the ball 23 in a closing direction (closing direction herein corresponds to toward the left in FIG. 1).

When pressure at the positive pressure applied region 110 exceeds a predetermined value, the relief valve R moves the ball 23 in an opening direction (opening direction herein corresponds to toward the right in FIG. 1) against the biasing force of the helical compression spring 24. Consequently oil is discharged from the positive pressure applied region 110 to the outer plate surface 6*b* of the side plate member 6 and thereby the pressure at the positive pressure applied region 110 is prevented from being increased.

A second recessed portion 16*c* is formed at the inner wall surface 16*a* of the second resin case 16 surrounding the electric power control portion Hb of the housing H. The second recessed portion is opened toward the first recessed portion (22) provided at the side plate member (6). The second recessed portion 16*c* is engaged with an outer end of the helical compression spring 24 (outer herein corresponds to toward the right in FIG. 1).

A through hole 25 is formed at a position of side plate member 6 corresponding to the negative pressure applied region 110 so as to extend from the inner plate surface 6*a* to the outer plate surface 6*b* in parallel to the main axis X1. A flow space S (a cooling passage) is formed between the outer plate surface 6*b* of the side plate member 6 and the inner wall surface 16*a* of the housing H. Oil discharged from the relief valve R flows from the flow space S to the though hole 25 and is thereby discharged to the negative pressure applied region 100. Consequently, the pressure at the positive pressure applied region 110 is prevented from being increased.

According to the electric pump of this embodiment, the electric power control portion Hb selectively supplies the electric power to the plurality of coils 14, on the basis of the rotational position of the outer rotor 5 determined by the sensing processing portion, and thereby the outer rotor 5 is rotatably driven around the main axis X1. Since the outer rotor 5 is rotated in such manner, the inner rotor 4, whose first teeth 4G are engaged with the second teeth 5G of the outer rotor 5, is rotated around the shaft 3, that is, around the sub axis X2.

At the time of the rotation of the inner and outer rotors 4 and 5, the negative pressure is applied at the negative pressure applied region 100 and the positive pressure is applied at the positive pressure applied region 110. Therefore, oil is sucked into the suction port 10 and is discharged from the discharge port 11.

In a case where oil pressure at a discharge side is increased during oil suction and discharge performance of the electric pump because of increase of a load that is applied to the discharge port 11, the pressure at the positive pressure applied region 110 is increased. In a case where the pressure at the positive pressure applied region 110 exceeds the predetermined value, the ball 23 is moved to the opening position against the biasing force of the helical compression spring 24. Consequently oil is discharged from the positive pressure applied region 110 to the outer plate surface 6*b* of the side plate member 6.

Thus, oil, discharged from the relief valve R to the outer plate surface 6*b*, flows from the flow space S to the through hole 25, so that oil at the positive pressure applied region 110 is prevented from being increased.

According to this embodiment, the relief valve R is provided at the side plate member 6. Therefore, oil discharged from the relief valve R sequentially flows from the outer plate surface 6*b* of the side plate member 6, through the flow space S and the through hole 25 and thereby discharged to the negative pressure applied region 100. In other words, even though a relief valve is not provided between the suction port 10 and the discharge port 11 so as to form a bypass, the relief valve R is arranged by simply processing the side plate member 6, in order to reduce a size of the electric pump. Further, oil flowing through the flow space S contacts the inner wall surface 16*a* of the electric power control portion Hb of the housing H and thereby cooling the electric power control portion Hb.

The electric pump according to the above embodiment may be modified in a manner described hereinbelow.

Figure 4:
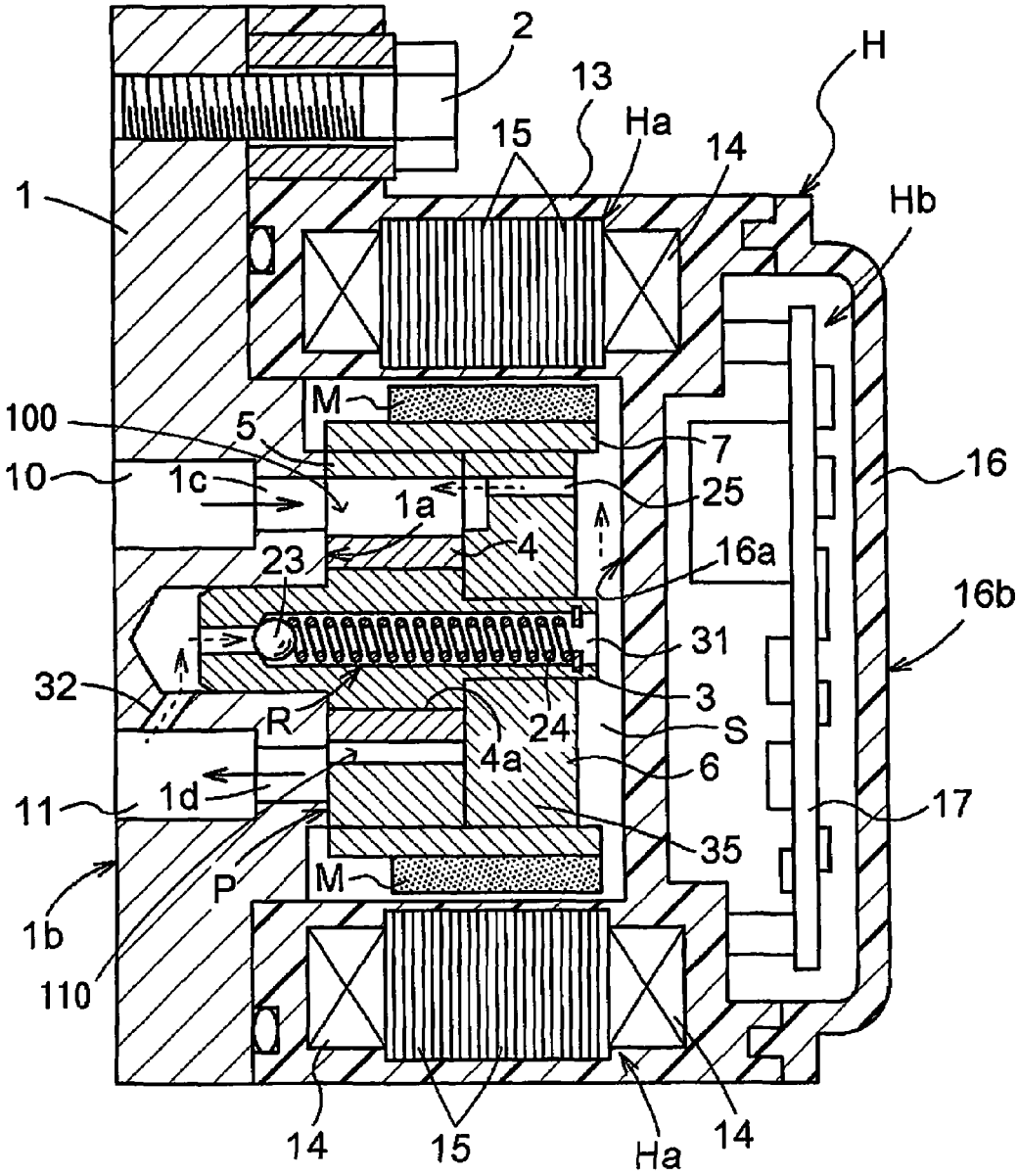
FIG. 4 is a cross-sectional view illustrating a structure of an electric pump according to another embodiment.

As illustrated in FIG. 4, the relief valve R is accommodated in the shaft 3. In other words, a main oil passage 31 (a fluid passage) is formed coaxially to an axis of the shaft 3 so as to extend from one end portion of the shaft 3 corresponding a base member 1 to the other end portion thereof corresponding to the side plate member 6.

An inner diameter of the main oil passage 31 is formed in a predetermined value from a portion penetrating the side plate member 6 to a portion thereof in the vicinity of the end portion corresponding to the base member 1. An inner diameter of a distal end of the main oil passage 31 accommodated in the base member 1 is formed in a smaller value than the predetermined value. An oil passage hole 32 is formed at the base member 1 so that the discharge port 11 of the base member 1 and the main oil passage 31 provided inside the shaft 3 communicate.

The ball 23 (a valve body), is inserted into the main oil passage 31. The helical compression spring 24 is provided in the main oil passage 31. The helical compression spring 24 biases the ball 23 in the closing direction.

The relief valve R is thus configured. Therefore, when the pressure at the positive pressure applied region 110 exceeds the predetermined value, the ball 23 is moved to the opening direction against the biasing force of the helical compression spring 24. As a result of such movement, oil at the positive pressure applied region 110 flows sequentially through the oil passage hole 32, the main oil passage 31 and the flow space S of the outer plate surface 6*b* and thereby discharged through the through hole 25 of the side plate member 6 to the suction port 10. Accordingly, the pressure at the positive pressure applied region 110 is prevented from being increased.

Figure 5:
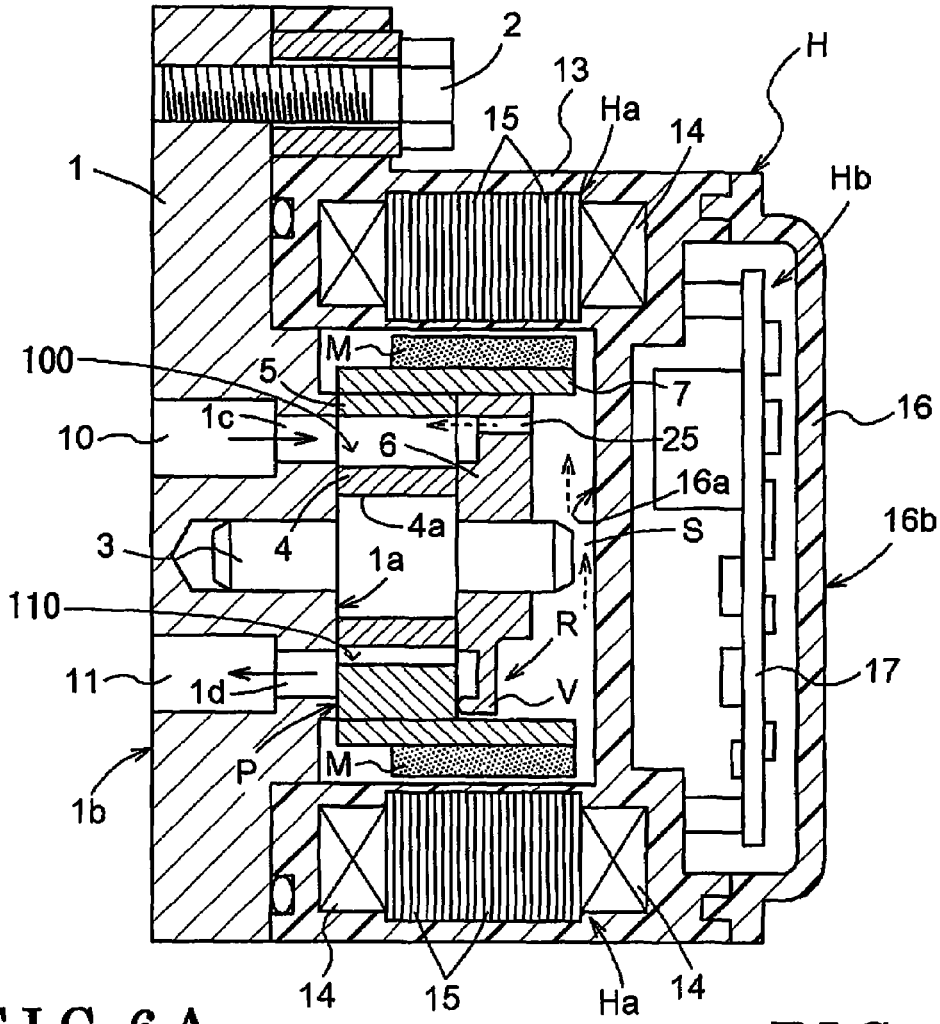
FIG. 5 is a cross-sectional view illustrating a structure of an electric pump according to a further embodiment.

As illustrated in FIG. 5, the relief valve R is configured so that a portion of the side plate member 6 corresponding to the positive pressure applied region 110 is configured to be elastically deformable. A thickness of the portion of the side plate member 6 in a direction of the sub axis X2 corresponding to the positive pressure applied region 110 is formed thinner than the other portions thereof and thereby an open-close valve V (a valve body) is configured so as to be elastically deformable.

The through hole 25, extending from the inner plate surface 6*a* to the outer plate surface 6*b*, is provided at a portion of the side plate member 6 corresponding to the negative pressure applied region 100. A flow space S is formed between the outer plate surface 6*b* of the side plate member 6 and the inner wall surface 16*a* of the housing H.

Figure 6A:
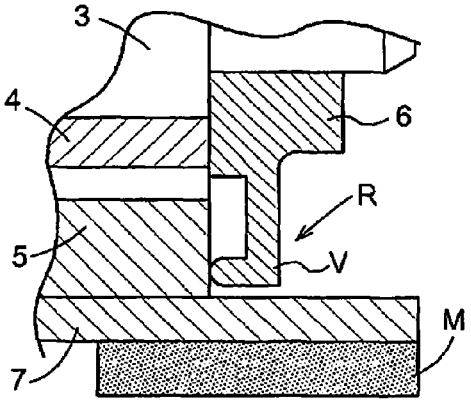
FIG. 6A is a cross-sectional view illustrating an operation of an open-close valve according to the embodiment of FIG. 5.
Figure 6B:
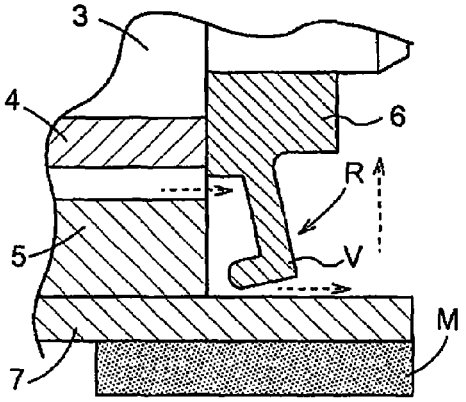
FIG. 6B is a cross-sectional view illustrating the operation of the open-close valve according to the embodiment of FIG. 5.

When the pressure at the positive pressure applied region 110 is lower than the predetermined value, the open-close valve V maintains a state contacting a portion in the vicinity of the outer circumference of the outer rotor 5, as illustrated in FIG. 6A. On the other hand, when the pressure at the positive pressure applied region 110 exceeds the predetermined value, the open-close valve V is elastically deformed in a direction to be spaced away from the outer circumference of the outer rotor 5, as illustrated in FIG. 6B. By the elastic deformation, oil sequentially flows from around the open-close valve V to the flow space S and the through hole 25 and is thereby discharged to the negative pressure applied region 100. Consequently, the pressure at the positive pressure applied region 110 is prevented from being increased.

A spool (a valve body) biased by a spring or a poppet (a valve body) biased by a spring is used as the relief valve V.

Accordingly, when the pressure applied at the positive pressure applied region 110 exceeds the predetermined value, oil is discharged from the positive pressure applied region 110 to the outer plate surface 6*b* of the side plate member 6 provided opposite from the positive pressure applied region 100, by means of the relief valve R. Therefore, the pressure applied at the positive pressure applied region 110 is reduced. Further, oil is discharged via the relief valve R to the outer plate surface 6*b* of the side plate member 6. Therefore, compared to the known electric pump in which a relief valve is provided at a bypass portion between the suction port 10 and the discharge port 11, a length of a passage through which the fluid flows between the pump portion P and the suction and discharge ports 10 and 11 do not need to be elongated. Therefore, the electric pump having the relief valve R is downsized.

According to the embodiment, the relief valve R includes the ball 23, inserted into the first recessed portion 22 formed at the side plate member 6 and the helical compression spring 24 biasing the ball 23 in a closing direction.

Accordingly, the relief valve R is configured by a portion of the side plate member 6. Therefore, the relief valve R is downsized and thereby the electric pump is downsized.

According to the embodiment, the relief valve includes the ball 23 inserted into the main oil passage 31 formed at the shaft and the helical compression spring 24 biasing the ball 23 in the closing direction.

Accordingly, the shaft 3 is effectively utilized.

According to the embodiment, the housing H accommodates the magnetic field producing portion Ha, provided at the position surrounding the outer rotor 5 and the electric power control portion Hb, controlling the magnetic producing portion Ha. The housing H forms the cooling passage S through which the fluid, discharged from the relief valve R, flows in the vicinity of the electric power control portion Hb.

Accordingly, oil discharged from the relief valve R flows through the cooling passage S in the vicinity of the driver. Therefore, the electric power control portion Hb is cooled.

According to the embodiment, the cooling passage S is formed between the outer plate surface 6*b* of the side plate member 6 and the housing H.

According to the embodiment, the electric power control portion Hb is provided inside the housing H at the position corresponding to the outer plate surface 6*b* of the side plate member 6. The housing H includes the inner wall surface 16*a* separating the electric power control portion Hb from the side plate member 6. The cooling passage S is formed between the outer plate surface 6*b* of the side plate member 6 and the inner wall surface 16*a* of the housing H.

According to the embodiment, the electric pump further includes the though hole 25 connecting the cooling passage S and the negative pressure applied region 100.

According to the embodiment, the through hole 25 extends from the inner plate surface 6*a* of the side plate member 6 to the outer plate surface 6*b* of the side plate member 6 in parallel to the main axis X1.

According to the embodiment, the base member 1 is fixed at the housing H. One end of the shaft 3 is fixed at the base member 1 and the other end of shaft 3 is fixed at the side plate member 6.

According to the embodiment, the electric pump further includes: the first recessed portion 22, provided at the side plate member 6 and opened towards the cooling passage S; and the second recessed portion 16*c*, provided at the inner wall surface 16*a* of the housing H, opened towards the first recessed portion 22 and receiving one end of the helical compression spring 24.

According to the embodiment, the main oil passage 31 extends in the direction of the sub axis X2 and opens toward the outer plate surface 6*b* of the side plate member 6. The helical compression spring 24 is provided inside the main oil passage 31.

According to the embodiment, the relief valve R is a valve body V integrally provided at the side plate member 6. The valve body V is elastically deformed by a pressure of the fluid discharged from the positive pressure applied region 110 and thereby discharging the fluid from the positive pressure applied region 110 to the outer plate surface 6*b* of the side plate member 6.

According to the embodiment, the valve body V is provided at the side plate member 6 at a position corresponding to the positive pressure applied region 110. The thickness of the valve body V is thinner than the other portion of the side plate member 6.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An electric pump comprising:

a housing;

an outer rotor accommodated in the housing and rotated around a first axis by a magnetic field produced by the housing;

an inner rotor rotated around a second axis displaced to the first axis in a manner where an outer circumference thereof contacts an inner circumference of the outer rotor;

a base member facing one side surface of the outer rotor and one side surface of the inner rotor;

a side plate member having a facing surface facing the other side surface of the outer rotor and the other side surface of the inner rotor and a non-facing surface opposed to the facing surface;

a shaft rotatably supporting the inner rotor and extending from the base member through the side plate member in a direction of the second axis;

a suction port provided at the base member and sucking fluid;

a discharge port provided at the base member and discharging fluid to an exterior of the housing;

a negative pressure applied region provided between the outer rotor and the inner rotor and communicating to the suction port;

a positive pressure applied region provided between the outer rotor and the inner rotor and communicating to the discharge port; and a relief valve discharging the fluid from the positive pressure applied region to a non-facing surface side of the side plate member when a pressure applied at the positive pressure applied region exceeds a predetermined value.

2. The electric pump according to claim 1, wherein the relief valve includes a valve body inserted into a first recessed portion formed at the side plate member, and a spring biasing the valve body in a closing direction.

3. The electric pump according to claim 1, wherein the relief valve includes a valve body inserted into a fluid passage formed at the shaft, and a spring biasing the valve body in a closing direction.

4. The electric pump according to claim 3, wherein the fluid passage extends in the direction of the second axis and opens toward the non-facing surface of the side plate member, and wherein the spring is provided inside the fluid passage.

5. The electric pump according to claim 1, wherein the housing accommodates a magnetic field producing portion provided at a position surrounding the outer rotor and an electric power control portion controlling the magnetic producing portion, and wherein the housing forms a cooling passage through which the fluid, discharged from the relief valve, flows in the vicinity of the electric power control potion.

6. The electric pump according to claim 5, wherein the cooling passage is formed between the non-facing surface of the side plate member and the housing.

7. The electric pump according to claim 5, wherein the electric power control portion is provided inside the housing at a position corresponding to the non-facing surface of the side plate member, the housing includes an inner wall separating the electric power control portion from the side plate member, and wherein the cooling passage is formed between the non-facing surface of the side plate member and the inner wall of the housing.

8. The electric pump according to claim 5 further comprising:

a though hole connecting the cooling passage and the negative pressure applied region.

9. The electric pump according to claim 8, wherein the through hole extends from the facing surface of the side plate member to the non-facing surface of the side plate member in parallel to the first axis.

10. The electric pump according to claim 1 wherein, the base member is fixed at the housing, and wherein one end of the shaft is fixed at the base member and the other end of shaft is fixed at the side plate member.

11. The electric pump according to claim 5 further comprising:

a first recessed portion provided at the side plate member and opened towards the cooling passage; and a second recessed portion provided at the inner wall of the housing, opened towards the first recessed portion and receiving one end of the spring.

12. The electric pump according to claim 1, wherein the relief valve is a valve body integrally provided at the side plate member and wherein, the valve body is elastically deformed by a pressure of the fluid discharged from the positive pressure applied region and thereby discharging the fluid from the positive pressure applied region to the non-facing surface of the side plate member.

13. The electric pump according to claim 12, wherein the valve body is provided at the side plate member at a position corresponding to the positive pressure applied region, and wherein a thickness of the valve body is thinner than the other portion of the side plate member.

* * * * *